United States Patent [19]

Yamamoto

[11] Patent Number: 4,785,836

[45] Date of Patent: Nov. 22, 1988

[54] SPRAY WASHER

[76] Inventor: Soichiro Yamamoto, 100 Ferrier Street, Markham, Ontario, Canada, L3R 2Z5

[21] Appl. No.: 74,758

[22] Filed: Jul. 17, 1987

[51] Int. Cl.[4] ..... B08B 3/02

[52] U.S. Cl. ..... 134/56 R; 134/104; 134/111; 134/170; 134/171; 134/200; 134/195

[58] Field of Search ..... 134/56 R, 57 R, 104, 134/109–111, 166 R, 170–171, 195, 198–200

[56] References Cited

U.S. PATENT DOCUMENTS

| | | | |
|---|---|---|---|
| 2,471,506 | 5/1949 | Wiswall | 134/195 |
| 2,558,628 | 6/1951 | Redin | 134/22.18 X |
| 2,682,273 | 6/1954 | Roach | 134/200 |
| 2,797,530 | 7/1957 | Garver | 134/200 |
| 3,070,104 | 12/1962 | Faust et al. | 134/171 |
| 3,771,539 | 11/1973 | DeSantis | 134/170 X |
| 4,025,363 | 5/1977 | DeSantis | 134/200 X |
| 4,051,858 | 10/1977 | Mele | 134/56 R |

FOREIGN PATENT DOCUMENTS

| | | | |
|---|---|---|---|
| 191993 | 10/1907 | Fed. Rep. of Germany | 134/111 |

*Primary Examiner*—Timothy F. Simone
*Assistant Examiner*—Stephen F. Gerrity
*Attorney, Agent, or Firm*—Moss, Hammond

[57] ABSTRACT

A cleaning apparatus for paint spray gun assemblies includes a cleaning cabinet, a paint cleaning fluid flow-line system and a pneumatic system for circulation of the cleaning fluid through the flow-line system; fluid outlets in the flow-line system eject cleaning fluid under pressure within the cabinet; paint spray guns are supported in the cabinet with paint passage interiors of the guns in direct fluid flow communication with fluid outlets; typically there is a plurality of fluid outlets for cleaning a plurality of spray gun assemblies simultaneously, a time control in the pneumatic system interrupts the circulation of cleaning fluid with a predetermined period, usually less than 60 seconds.

9 Claims, 5 Drawing Sheets

SPRAY WASHER

BACKGROUND OF THE INVENTION (I) Field of the Invention

This invention relates to a method and apparatus for automatic cleaning of paint spray gun assemblies and their component parts.

(II) Description of Prior Art

Paint workshops employ paint spray gun assemblies for painting of products, particularly in the automobile industry. Syphon spray guns are usually employed for small jobs requiring a small amount of paint, whereas pressure spray guns are usually employed for larger jobs. By means of such spray guns, products can be painted rapidly. After a particular job using a particular paint, the gun assemblies must be thoroughly cleaned of the paint before use with a different colour paint. The cleaning operation represents downtime in the use of the gun assemblies, necessitating that the workshop have a large number of gun assemblies if the skilled paint sprayer is to be kept employed for paint spraying operations with different with different paint colours throughout the day.

In addition the cleaning operation is an unpleasant and hazardous task requiring use of noxious, volatile, paint solvents, which are generally flammable and nauseous. Typically the cleaning operation will involve a period of immersing the gun assembly in an open vat of the cleaning fluid, allowing the assembly to soak in the fluid and using a metal brush or scraper to loosen paint debris, followed by rinsing with fresh cleaning fluid.

SUMMARY OF THE INVENTION

It is an object of this invention to provide an apparatus and method for automatic cleaning of paint spray gun assemblies.

It is a further object of this invention to provide such an apparatus and method capable of cleaning a plurality of such gun assemblies.

It is a still further object of this invention to provide such an apparatus and method which is capable of cleaning one or more gun assemblies in a very short time.

It is yet another object of this invention to provide such an apparatus and method which avoids or minimizes the hazards associated with exposure to noxious paint cleaning fluids.

Other objects and advantages will be evident from the following description.

In accordance with one aspect of the invention a cleaning apparatus for automatic cleaning of paint spray gun assemblies comprises a cleaning cabinet, a paint-cleaning fluid flow-line system, and means for effecting circulation of the fluid, under pressure, through the flow-line system. A plurality of cleaning fluid outlets in the flow-line system permit ejection of the fluid under pressure within the cabinet. Support means associated with some of the fluid outlets are adapted to support the spray guns in the cabinet with paint passage interiors of the guns in direct fluid flow communication with such outlets.

In accordance with another aspect of the invention a cleaning apparatus for automatic cleaning of paint spray gun assemblies comprises: a cleaning cabinet, a paint-cleaning fluid flow-line system, means for effecting circulation of the fluid under pressure through the flow-line system, outlet means in the flow-line system for ejection of cleaning fluid under pressure within the cabinet and support means for supporting at least one spray gun in the cabinet with a paint passage interior of the at least one spray gun in direct fluid flow communication with the outlet means. The circulation means includes time control means adapted to interrupt the circulation within a predetermined time. Typically the interruption of circulation comprises ceasing circulation within 30 to 60 seconds, preferably about 45 seconds, after circulation commences. Thus the cleaning cycle or operation is complete in 30 to 60 seconds.

The use of the high pressure ejection, in accordance with the invention, whereby jets of cleaning fluid impinge on paint soiled surfaces, results in rapid removal of the paint in a surprisingly short time. Although the cleaning cycle could be continued beyond 60 seconds, this is unnecessary and wasteful since no further advantage is obtained. Indeed in so far as extending the cycle beyond 60 seconds results in recycling of fluid containing entrained paint debris into contact with the cleaned parts which could result in deposition of paint debris on the parts, such extension is disadvantageous.

In still another aspect of the invention a method of cleaning at least one paint spray gun assembly comprises: supporting the at least one paint spray gun in a cleaning cabinet, and impinging paint contacting surfaces of the at least one gun, with a cleaning fluid under pressure within the cabinet for a short predetermined time.

The paint contacting surfaces of the gun are, in particular, the walls of the paint passage interior of the gun, which walls are contacted by paint as it flows through the gun. However, other surfaces, including exterior surfaces, of the gun which may be exposed directly or indirectly to paint in use, are also contemplated.

BRIEF DESCRIPTION OF THE DRAWINGS

The invention is illustrated in particular and preferred embodiments by reference to the accompanying drawings in which.

DESCRIPTION OF THE PREFERRED EMBODIMENTS WITH REFERENCE TO THE DRAWINGS

Figure 1:
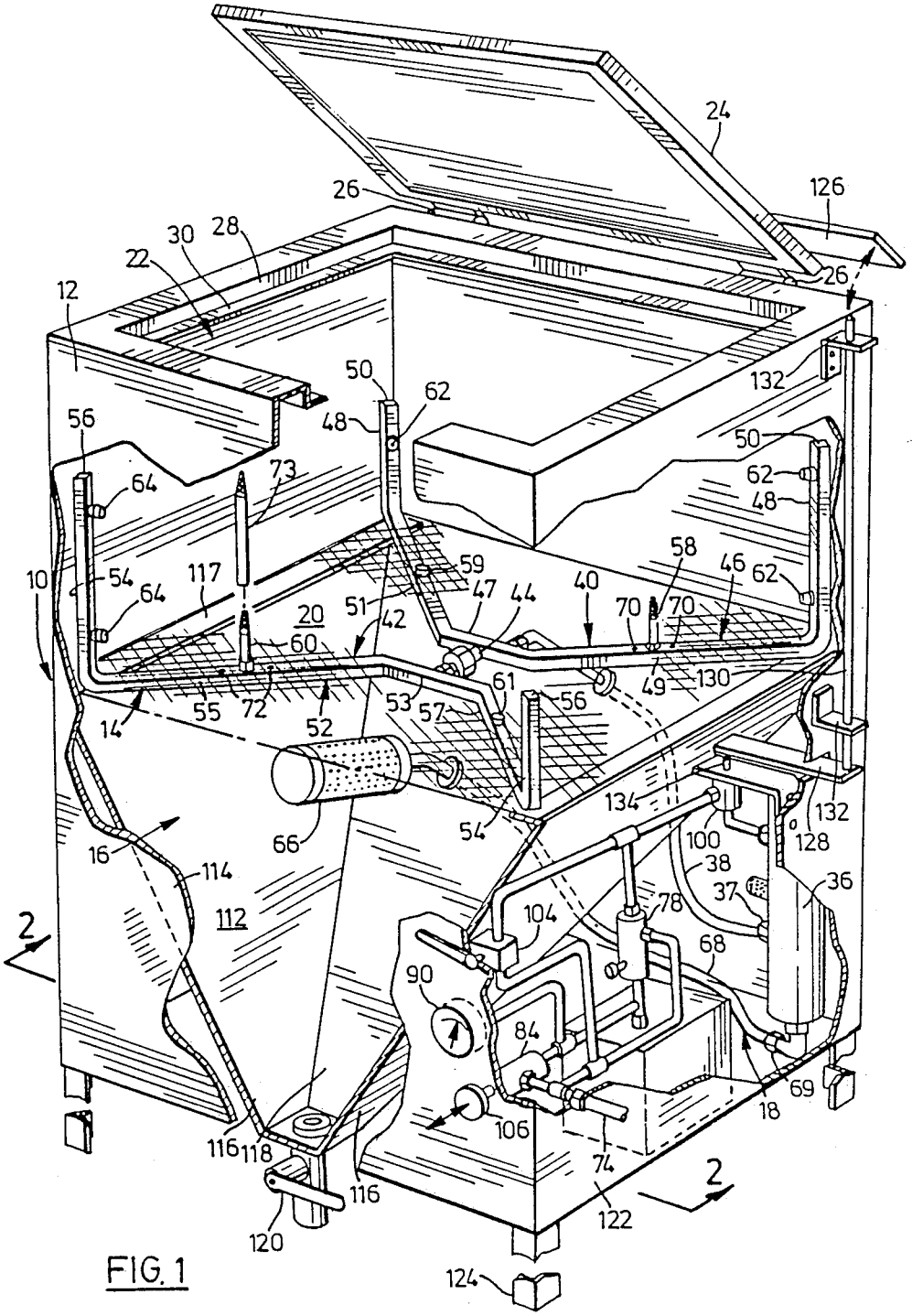
FIG. 1 is a perspective view of the cleaning apparatus in accordance with the invention, part cut away to show the interior.

With particular reference to FIG. 1, a cleaning apparatus 10 includes a cleaning cabinet 12, a cleaning fluid flow-line system 14, a bath 16 and a pneumatic circulating system 18.

Cleaning cabinet 12 includes a support screen 20 at its lower end and a top opening 22. A lid 24 is hingedly mounted by hinges 26 along one side of top opening 22.

Top opening 22 includes an inner shoulder 28 having a ledge 30 to support lid 24 when closed.

The cleaning fluid flow-line system 14 includes a cleaning fluid pump 36 having a pump fluid outlet 37 communicating with a fluid delivery line 38.

Fluid delivery line 38 is in fluid flow communication with a distribution tube 40 connected via a connection tube 44 with a distribution tube 42.

Distribution tube 40 includes a horizontal pipe 46 spanning one side of the area below screen 20, and terminating at its opposed ends in a pair of vertical pipes 48 having closed upper ends 50.

Similarly distribution tube 42 includes a horizontal pipe 52, spanning the other side of the area below screen 20, and having vertical pipes 54 at its opposed ends, the latter terminating in closed ends 56.

Horizontal pipes 46 and 52 have short intermediate pipe portions 47 and 53, respectively, which are generally parallel; connection tube 44 extends between opposed intermediate pipe portions 47 and 53.

Outer pipe portions 49 and 51 of horizontal pipe 46 extend from opposed ends of intermediate pipe portion 47 to the vertical pipes 48; similarly outer pipe portions 55 and 57 of horizontal pipe 52 extend from opposed ends of intermediate pipe portion 3 to the vertical pipes 54.

An ejection tube 58 and a wide angle nozzle 59 are formed in horizontal pipe portion 46 in the respective outer pipe portions 49 and 51; and an ejection tube 60 and a wide angle nozzle 61 are formed in horizontal pipe portion 52, in the respective outer pipe portions 55 and 57. The wide angle nozzles 59 and 61 project through screen 20. Wide angle nozzles 62 are formed in vertical pipes 48 and wide angle nozzles 64 are formed in vertical pipes 54.

A pair of ejection orifices 70 is formed in outer pipe portion 49 on either side of ejection tube 58; and ejection orifices 72 are formed in outer pipe portion 55, one on either side of ejection tube 60.

An adapter 73 is provided for fitting on ejection tube 58 or 60. The tapered upper end portions of adapter 73 and ejection tubes 58 and 60 are roughened, such as by knurling, grooving or providing same with opposed flats 180° apart to cause some leakage in use as described further below.

A strainer cartridge 66 is connected via a return line 68 to a pump fluid inlet 69 in fluid pump 36.

Figure 3:
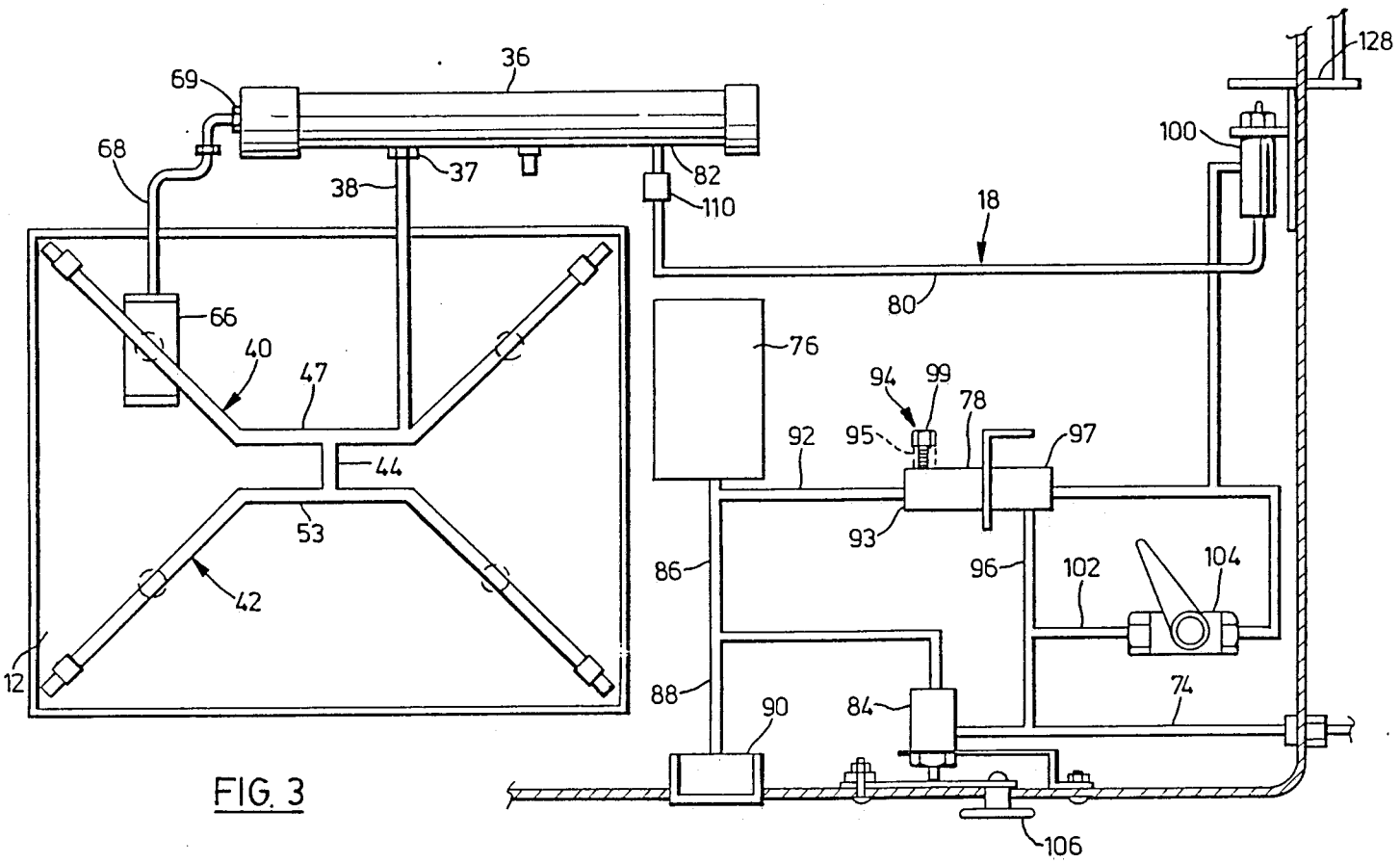
FIG. 3 is a schematic representation of the cleaning fluid flow-line system and pneumatic circulating system of the apparatus of FIG. 1.

Referring in particular to FIG. 3, pneumatic circulating system 18 includes an air inlet line 74 an air accumulator 76, a pneumatic timer valve 78 and an air delivery line 80 communicating with fluid pump 36 via an air inlet port 82.

Air inlet line 74 communicates via a valve 84 with an accumulator inlet line 86 which communicates with air accumulator 76.

A branch line 88 in accumulator inlet line 86 communicates with an air pressure gauge 90.

An accumulator outlet line 92 communicates air accumulator 76 with an inlet end 93 of pneumatic timer valve 78. Pneumatic timer valve 78 includes a timer adjuster 94 including an air escape port 95 having an adjustable closure 99 which specifically may comprise a screw closure received in port 95.

Branch line 96 from air inlet line 74 communicates with outlet end 97 of pneumatic timer valve 78.

A lid safety valve 100, the operation of which is described later, is disposed in air delivery line 80 between pneumatic timer valve 78 and air inlet port 82.

A branch line 102 extends between branch line 96 and air delivery line 80. Air control valve 104 is disposed in branch line 102.

A timer button 106 is operably associated with valve 84.

A restrictor 110 in air delivery line 80 limits air flow therein to control the speed of pump 36.

Bath 16 includes a chamber 112 having a vertical front wall 114, a pair of inclined side walls 116 and an inclined rear wall 118. Side walls 116 have support flanges 117. The chamber 112 has the form of an inverted, truncated pyramid, askewed so as to have a straight, vertical front wall 114. A drain valve 120 is disposed at the juncture of the lower ends of the walls 114, 116 and 118, and thus at the front side of chamber 112. A skirt 122 surrounds the chamber 112 and stands on legs 124, part of the skirt 122 actually forming front wall 114 of chamber 112.

An activator plate 126 is supported on lid 24 and a switch plate 128 is operably associated with lid safety valve 100. A vertically movable switch rod 130 is attached to switch plate 128 and guided by guides 132. Switch plate 128 engages a spring loaded plunger 134 in safety valve 100. Valve 100 is normally closed, so that downward movement of switch plate 100 caused by closure of lid 24 opens safety valve 100 and vice versa.

Figure 2:
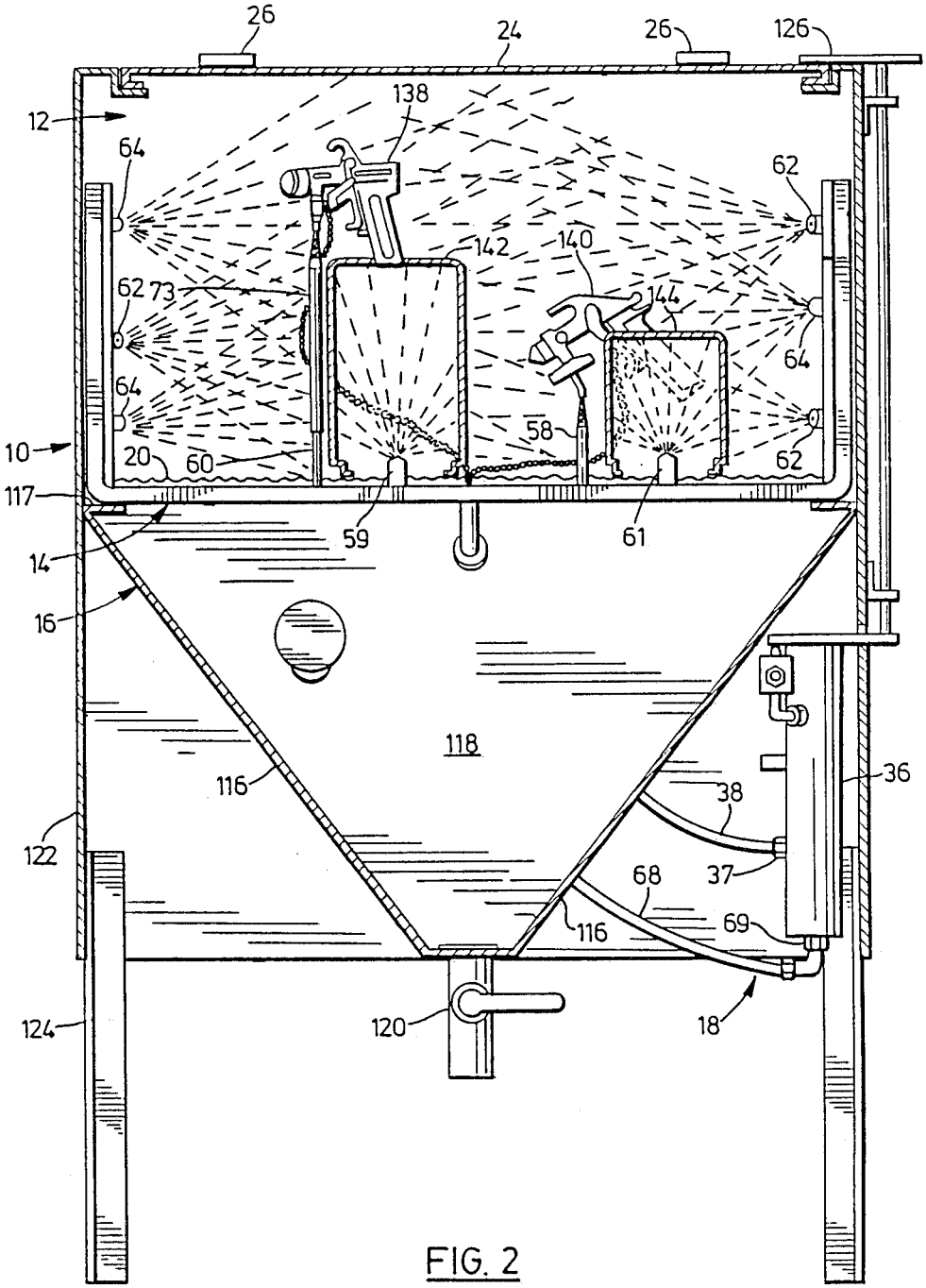
FIG. 2 is a front elevation of the apparatus of FIG. 1 as a partial cross section to show the interior.

With particular reference to FIG. 2, an optional adapter 73 is mounted over ejection tube 60; adapter 73 defining a sleeve configured and dimensioned at an inner end to matingly receive outer end of ejection tube 60; the outer end of adapter 73 being configured and dimensioned to be matingly received within a paint passage inlet of pressure spray gun 138. Pressure spray gun 138 with its trigger closed is thus supported on adapter 73. A syphon type spray gun 140 is supported on ejection tube 58, the outer end of ejection tube 58 being configured and dimensioned to be matingly received within a paint passage inlet of gun 140. It will be understood that adapter 73 could be supported on either ejection tube 58 or 60, and it could be eliminated if not needed depending upon the particular configuration or type of spray gun 138 to be cleaned.

A large canister 142 from pressure spray gun 138 is invertedly disposed over wide angle nozzle 59 and small canister 144 from syphon spray gun 140 is invertedly disposed over wide angle nozzle 61.

Figure 4:
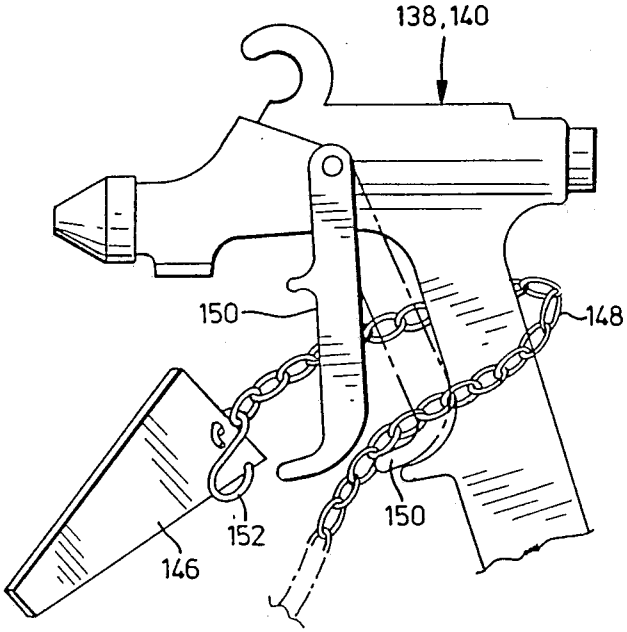
FIG. 4 shows a detail illustrating a device for holding the trigger of a spray gun closed, in the apparatus of FIG. 1.

With particular reference to FIG. 4, there is shown a portion of a typical spray gun 138, or 140 having a trigger 150 shown in solid lines in the open position and in phantom lines in the closed, working position. In the cleaning operation of apparatus 10, the trigger 150 is maintained in the closed, working position by tightening the trigger chain 148 and securing it by means of a link of the chain 148, in a tightened configuration, to hook 152 supported in wedge 146. In this way the paint flow-line through the spray gun 138, 140 is maintained fully open for passage of the cleaning fluid during the cleaning operation. The wedge 146 can itself be used to hold the trigger 150 in closed configuration in many guns.

In most paint spray guns of North American design the configuration of the body of the gun provides location in which the wedge 146 can be securely seated, with the wedge 146 holding or restraining the trigger 150 in the depressed or closed configuration. The chain 148 and hook 152 are useful for those spray guns, typically of European design, which do not have a body configuration facilitating direct use of wedge 146 to hold trigger 150 closed.

In operation lid 24 is opened and water is introduced through top opening 22 to chamber 112. Drain valve 120 should of course, be closed. The upper level of the water should be below strainer cartridge 66. Cleaning fluid is thereafter introduced through top opening 22 to form a layer of fluid above the water in chamber 112. The cartridge 66 should be contained within the layer of cleaning fluid. Suitably the upper surface of the cleaning fluid layer should just reach the base of the distribution tubes 40 and 42 but, in any event, should be below the outlets of wide angle nozzles 59 and 61, and preferably below support screen 20.

For the case in which a pressure spray gun 138 and a syphon spray gun 140 are to be cleaned, adapter 73 for the pressure spray gun 138 is mounted on, for example, ejection tube 60 and the outlet end of adapter 73 is inserted into the paint inlet of gun 138. The outer end of ejection tube 58 is inserted in the paint inlet line of gun 140. Canister 142 of pressure spray gun 138 is inverted and placed over, for example, wide angle nozzle 59 and canister 144 of spray gun 140 is inverted and placed over wide angle nozzle 61.

The triggers, for example, the trigger 150 of syphon spray gun 140, are directly locked in the closed, working position with wedge 146, or as illustrated in FIG. 4, so that the paint flow passages of guns 138 and 140 are completely open for flow of cleaning fluid.

The lid 24 is closed and its engagement with ledge 30 prevents splashing of cleaning fluid during operation of apparatus 10.

In operation knob 106 is activated to open valve 84 and air is delivered through air inlet line 74 via normally closed valve 84 to the air accumulator 76, suitably at a pressure of 40–120 psi, and then to normally closed pneumatic timer valve 78. Accumulator 76 is pressurized almost instantaneously whereupon knob 106 is released to close valve 84. When a sufficient predetermined pressure is generated in air accumulator 76, pneumatic timer valve 78 opens, and air under pressure then passes directly from air inlet line 74 through branch line 96 to pneumatic timer valve 78 and then to air delivery line 80 to air inlet port 82 of pump 36. The air pressure in pump 36 activates a piston which forces cleaning fluid in the flow-line system 14, as jets under pressure from the ejector tubes 58 and 60 through the paint flow passages of the guns 138 and 140. At the same time the cleaning fluid is ejected through wide angle nozzles 59 and 61 as jets impinging on the interior surfaces of canisters 142 and 144, respectively, and through wide angle nozzles 62 and 64 to impinge on the exterior surface of guns 138 and 140 and canisters 142 and 144. As mentioned above, the roughened tapered upper end portions of adapter 73 and ejection tubes 58 and 60 are roughened to cause some leakage. This ensures that the part of the paint inlet lines of spray guns 138 and 140 containing these tapered upper end portions is also cleaned.

The ejector orifices 70 or 72, typically 0.0625 inches in diameter, direct cleaning fluid under pressure into any cup portion of a spray gun which skirts the paint passage inlet. The pressurized air in air accumulator 76 bleeds from pneumatic timer valve 78 through escape port 95 at a rate determined by closure 99 of timer adjuster 94, and when the pressure drops below a predetermined value pneumatic timer valve 78 closes thereby discontinuing the feed of air under pressure to pump 36.

In practice, time adjuster 94 is adjusted such that pneumatic timer valve 78 will be open for a period of not more than 60 seconds, typically 30 to 60 seconds and especially about 45 seconds, whereby pump 36 actively circulates cleaning fluid under pressure through flow line system 14 for this relatively short period of time.

The jets impinging on paint coated walls displace the paint which is entrained in the fluid and carried away by the fast moving fluid, descending into bath 16.

At completion of the short cleaning operation spray guns 138 and 140 and canisters 142 and 144 are removed. Support screen 20 acts as a safety net so that, for example, gun 138 cannot inadvertently fall into bath 16.

Apparatus 10 can then be used, to clean other guns and components thereof as required.

In use the cleaning fluid is cycled through bath 16 and flow-line system 14. The fluid ejected through ejector tubes 58 and 60 and wide angle nozzles 59, 61, 62 and 64 falls or flows downwardly into bath 16 from where fluid enters return line 68 through strainer cartridge 66 and thence to pump 36. Paint debris is filtered from the fluid by strainer cartridge 66 and generally forms an intermediate paint debris layer in bath 16, floating on the upper surface of the lower water layer. Periodically, after repeated uses of the cleaning cycle, drain valve 120 is opened and the water flows out, drawing with it the paint debris layer. Fresh water is then introduced through opening 22 and, if necessary, fresh cleaning fluid in order to restore the levels.

The formation of the paint debris layer floating on the water avoids or minimizes coating or accumulation of paint debris on the walls of chamber 112 which would present a removal problem after several cleaning operations.

The debris of certain types of paint, for example, water-based paints and some metal containing paints does migrate into the water layer, in which it disperses. The water layer can be replaced by other liquid layers, for example aqueous and other solvents which are immisable with the cleaning fluid, and of greater density such that the cleaning fluid floats thereon as an upper layer.

It is also possible to omit the water or other lower layer and use solely cleaning fluid.

The inclined walls 116 and 118 of chamber 112 facilitate descension of paint debris into the lower region of bath 16 during draining. The vertical front wall 114 enables location of drain valve 120 at a forward, front side of apparatus 10, so that it is readily accessible, without the hazard of crawling or extending the arm beneath bath 16.

In operation lid 24 is closed and activator plate 126 engages the upper end of switch rod 130 forcing it vertically downwardly within guides 132, whereby switch plate 128 depresses spring-loaded plunger 134 to open lid safety switch 100. When lid 24 is opened, activator plate 126 is disengaged from the upper end of rod 130 and spring-loaded plunger 134 is free to rise urging switch plate 128 and rod 130 vertically upwardly, the rising of plunger 134 closes safety valve 100 so that, if in a cleaning cycle, delivery of air under pressure to pump 36 ceases, the cleaning cycle is interrupted. In this way the hazard of splashing of cleaning fluid from top opening is avoided or minimized.

Restriction 110 in air delivery line 80 is, for example, a small orifice of about 0.05 inches diameter, and limits the air flow to pump 36.

This prevents the pump 36 running too fast, while still permitting development of the elevated pressure required to operate pump 36.

Chamber 112 is suitably of metal, for example, aluminium or stainless steel. The materials of the component parts of apparatus 10 should, of course, be selected having regard to the noxious fluids which they are to contact.

Pump 36 will suitably operate at a pumping rate of about 2 to 8 gal./min. Generally a pneumatic pump 36 is preferred, and, in particular electric pumps are to be avoided in view of the use of the noxious, volatile and flammable fluids.

The distribution tubes 40 and 42, suitably comprise a discrete unit with connection tube 44, of zinc plated steel or aluminium. As shown in FIG. 1, this discrete unit will sit or stand on support flanges 117 and there is no need for bolts or other connection members which may result in leaks.

The wide angle nozzles 59, 61, 62 and 64 suitably provide a full core jet encompassing a spray angle of 72°-80°. The nozzles are suitably of brass, aluminum, polypropylene or other inert material.

The wedge 146 is suitably of high density polyethylene or of metal.

The cleaning fluid may suitably be lacquer thinner, paint thinner or other cleaning fluid, for paint and the like, such as methanol, naphthalene or mineral spirits.

Optionally water may be omitted from bath 16, and a bath 16 of cleaning fluid employed. Suitably bath 16 has a capacity of 5 to 10 gallons.

Figure 6:
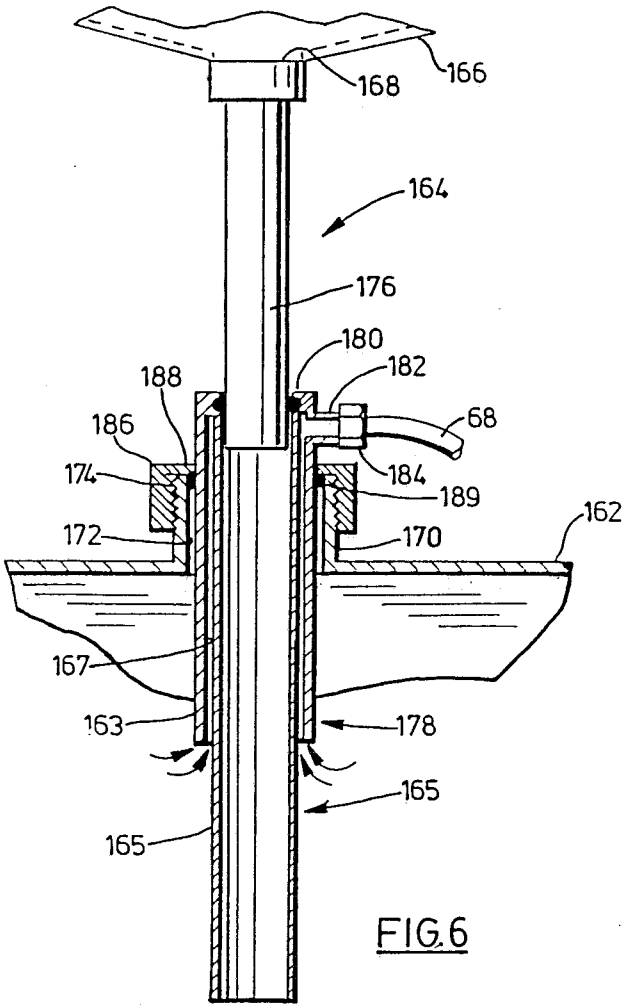
FIG. 6 shows a detail of the apparatus of FIG. 5.
Figure 5:
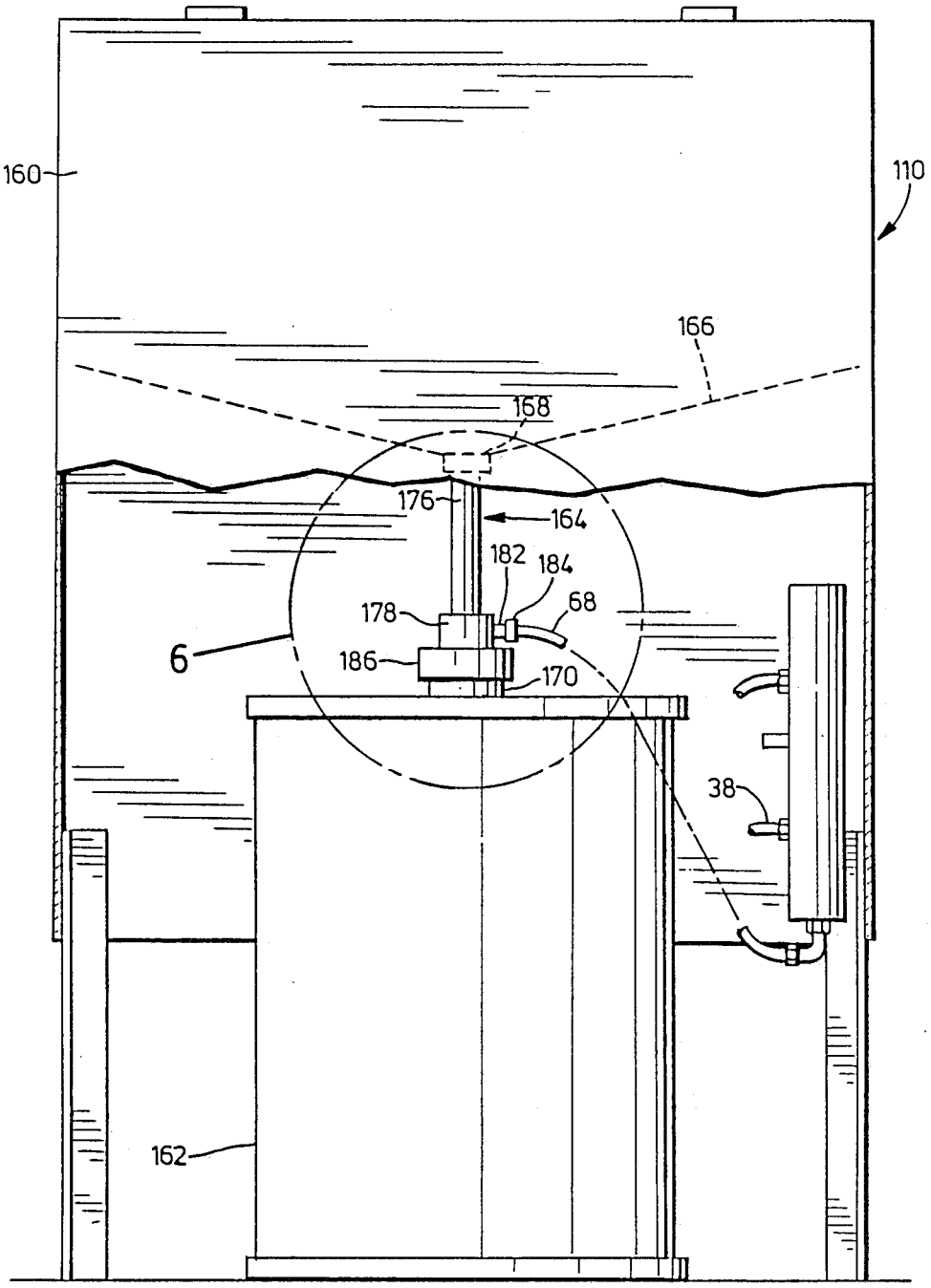
FIG. 5 is a schematic representation of part of a cleaning apparatus in a different embodiment of the invention.

With further reference to FIGS. 5 and 6, there is shown a variation of apparatus 10 of FIG. 1, particularly as to bath 16.

The apparatus 110 of FIGS. 5 and 6 has a cabinet 160, a disposable container or drum 162 and a flow pipe assembly 164. The fluid flow-line system and pneumatic circulation system (not shown) are in general and same as described for FIG. 1.

Cabinet 160 has a shallow dished floor 166 having the shape of an inverted wide angle cone; floor 166 has a flow opening 168 at its central, lowermost part.

Drum 162 has an upper neck 170 defining a passage 172 having an outer threaded portion 174.

Flow pipe assembly 164 has a short central pipe 176 and an outer pipe assembly 178 is slidably disposed concentrically about central pipe 176. Annular fluid resistant seal 180 is disposed between an upper end of outer pipe assembly 178 and central pipe 176.

Outer pipe assembly 178 has an outer pipe 163 and an inner pipe 165, an annular passage 167 extends between outer pipe 163 and inner pipe 165.

Outlet port 182 is formed in outer pipe assembly 178 adjacent its upper end; outlet port 182 is in fluid flow communication with annular passage 167.

The upper end of central pipe 176 is in flow communication with flow opening 168, and its lower end extends a short distance into inner pipe 165 of outer pipe assembly, terminating above drum 162. The outer pipe 163 extends only a short distance into drum 162, whereas the inner pipe 165 extends deep into the interior of drum 162.

Return line 68 is connected by fitting 184 to outlet port 182 and delivery line 38 communicates with distribution tubes 40 and 42 (not shown) as in FIG. 1.

A closure cap 186 having a central opening 188 threadably engages threaded portion 174 of neck 170, with outer pipe assembly 178 slidably received in central opening 188; annular fluid resistant seal 189 is formed between neck 170 and outer pipe 163.

The cleaning fluid is housed in drum 162 and, in operation, inner pipe 165 suitably extends into the cleaning fluid.

The lower end of outer pipe 163 extends below the level of fluid in drum 162.

In operation, outer pipe assembly 178 is inserted through central opening 188 into drum 162; engagement of outlet port 182 with cap 186 prevents outer pipe assembly 178 from falling completely into the drum 162. The drum 162 with outer pipe assembly 178 is positioned below central pipe 176 and aligned therewith so that outer pipe assembly 178 can be slidably withdrawn from central opening 188 and slidably telescoped about central pipe 176 so that the lower end of central pipe 176 is contained within inner pipe 165. Outer pipe assembly 178 is then locked or fixed in position by any suitable means.

The cleaning cycle is initiated and proceeds as for apparatus 10 of FIG. 1; cleaning fluid flows upwardly through annular passage 167 around inner pipe 165 and thence, through outlet port 182 into return line 68 into pump 36 and then through delivery line 38. The ejected fluid falls or flows downwardly of floor 166 to flow opening 168 into central pipe 176 and thence into inner pipe 165 and into interior of drum 162. Thus used fluid is returned to an interior region of drum 162 and fluid for washing is drawn from an upper region. The paint debris tends to settle so that fluid in the upper region of the drum, from which fluid is drawn for cleaning, remains relatively paint-free.

After repeated use of the cleaning fluid, drum 62 containing the used fluid can be dispoed of.

In an alternative arrangement to that described by reference to FIGS. 5 and 6, the flow pipe assembly is vertically movable into cabinet 166 in order to raise the assembly 164 clear of drum 162 for installation and removal of drum 162. In such case, flow pipe assembly 164 might conveniently have a handle at its upper end, within cabinet 166, whereby it might be lifted.

Paint spray gun assemblies are used for applying other sprayable compositions, for example, glue, adhesive, and specialty coatings such as lubricants and mold release coatings. It will be understood that the invention is equally applicable to cleaning of guns used for such other sprayable compositions and for the purposes of this disclosure the term "paint" is intended to include all of these compositions.

I claim:

1. A cleaning apparatus for automatic cleaning of paint spray gun assemblies, comprising:

a cleaning cabinet having a bottom opening, a paint cleaning fluid flow-line system comprising a fluid distribution system, a pneumatically actuated fluid pump and a housing for cleaning fluid, said housing being below said bottom opening for circulating flow of fluid through said bottom opening to said housing, said fluid pump being adapted to effect circulation of cleaning fluid under pressure, through said flow-line system, said fluid pump having a fluid inlet and a fluid outlet, a fluid delivery line for flow of cleaning fluid from said fluid outlet to said fluid distribution system, and a return line for flow of cleaning fluid from said housing to said fluid inlet, a plurality of cleaning fluid outlets in said fluid distribution system for ejection of cleaning fluid under pressure within said cabinet, a sub-plurality of said outlets defining means for supporting a spray gun in said cabinet with a paint passage interior of the gun in direct fluid flow communication with a said outlet, an air-flow system having an air delivery line, said fluid pump having an air inlet in air flow communication with said air delivery line, said air-flow system and said fluid flow-line system having separate independent flow lines, and time control means in said air-flow system adapted to interrupt the action of the fluid pump and thence circulation of fluid in said fluid flow-line system within a predetermined time.

2. A cleaning apparatus according to claim 1, wherein said housing comprises a chamber for the cleaning fluid below said cabinet, said chamber having a substantially vertical front wall, and a drain valve adjacent a lower end of said front wall.

3. A cleaning apparatus according to claim 2, further including a restriction in said air delivery line to limit air flow.

4. A cleaning apparatus according to claim 3, wherein said fluid distribution system comprises first and second distribution tubes in opposed spaced apart relationship, and a connecting tube providing fluid flow communication between said distribution tubes, said first and second distribution tubes each having a substantially horizontal portion spanning one side of said cabinet, each horizontal portion terminating at its opposed ends in substantially vertical portions; at least one ejector tube extending upwardly of each of said horizontal portions; at least one upwardly directed wide angle nozzle in each of said horizontal portions; and at least one inwardly directed wide angle nozzle in each of said vertical portions.

5. A cleaning apparatus according to claim 4, further including ejection orifices in each of said horizontal portions, a pair of said ejection orifices being associated with each of the ejection tubes.

6. A cleaning apparatus according to claim 1, wherein said housing comprises a disposable drum for the cleaning fluid, below said cabinet; said cabinet having a floor sloping inwardly to a generally central fluid outlet port and a pipe assembly communicating said fluid outlet port with said drum.

7. A cleaning apparatus according to claim 1, wherein said cabinet has a lid and a safety valve means in the air-flow system operably connected to said lid to cease the circulation when the lid is opened.

8. A cleaning apparatus according to claim 1, including a wedge member adapted to hold a trigger of a spray gun in a closed, working position.

9. A cleaning apparatus according to claim 8, wherein said wedge member has a hook on a chain having a plurality of links, affixed thereto, said hook being adapted to engage a link of said chain such that said chain is held tightly about the spray gun and said trigger, said trigger being restrained in said working position.

* * * * *